US008016958B2

(12) United States Patent
Zhao et al.

(10) Patent No.: US 8,016,958 B2
(45) Date of Patent: Sep. 13, 2011

(54) HIGH STRENGTH ALUMINUM ALLOY SHEET AND METHOD OF PRODUCTION OF SAME

(75) Inventors: Pizhi Zhao, Shizuoka (JP); Toshiya Anami, Shizuoka (JP); Takayuki Kobayashi, Shizuoka (JP); Kiyomi Tsuchiya, Shizuoka (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 68 days.

(21) Appl. No.: 12/374,103

(22) PCT Filed: May 25, 2007

(86) PCT No.: PCT/JP2007/061149

§ 371 (c)(1),
(2), (4) Date: Jan. 16, 2009

(87) PCT Pub. No.: WO2008/010352

PCT Pub. Date: Jan. 24, 2008

(65) Prior Publication Data

US 2009/0269613 A1 Oct. 29, 2009

(30) Foreign Application Priority Data

Jul. 18, 2006 (JP) ..... 2006-195869

(51) Int. Cl.
*C22F 1/047* (2006.01)
*C22C 21/06* (2006.01)

(52) U.S. Cl. ..... 148/440; 420/547; 148/551

(58) Field of Classification Search ..... 148/440, 148/551; 420/547, 543, 553
See application file for complete search history.

(56) References Cited

FOREIGN PATENT DOCUMENTS

| | | | |
|---|---|---|---|
| CA | 2 300 815 | | 3/1999 |
| CA | 2300815 | | 3/1999 |
| CA | 2 540 409 | | 7/2005 |
| CA | 2540409 | | 7/2005 |
| CA | 2563789 | | 11/2005 |
| CA | 2588046 | | 2/2006 |
| JP | 07-278716 | A | 10/1995 |
| JP | 2000-080453 | A | 3/2000 |
| JP | 2005-307300 | A | 11/2005 |
| JP | 2005307300 | A * | 11/2005 |
| WO | WO 2005/103313 | | 11/2005 |

* cited by examiner

*Primary Examiner* — Roy King

*Assistant Examiner* — Janelle Morillo

(74) *Attorney, Agent, or Firm* — Millen, White, Zelano & Branigan, P.C.

(57) ABSTRACT

High strength aluminum alloy sheet having superior surface roughening and formability suitable for home electrical appliances and automobile outer panels and other structural materials and a method of production of the same are provided. High strength aluminum alloy sheet having a chemical composition containing Mg: 2.0 to 3.3 mass %, Mn: 0.1 to 0.5 mass %, and Fe: 0.2 to 1.0 mass %, having a balance of unavoidable impurities and Al, and having an Si among the unavoidable impurities of less than 0.20 mass % and having an average circle equivalent diameter of intermetallic compounds of 1 μm or less, having an area ratio of intermetallic compounds of 1.2% or more, having an average diameter of recrystallized grains of 10 μm or less, and having a tensile strength of 220 MPa or more. This is obtained by pouring an aluminum alloy melt having the above chemical composition in a twin belt caster, continuously casting a thin slab of a thickness of 6 to 15 mm at a cooling rate at a position of ¼ the slab thickness of 50 to 200° C./sec and winding it up into a coil, then cold rolling it at a cold reduction of 60 to 98%, final annealing it by a continuous annealing furnace at a heating rate of 100° C./min or more, at a holding temperature of 400 to 520° C. for a holding time of within 5 minutes.

15 Claims, No Drawings

HIGH STRENGTH ALUMINUM ALLOY SHEET AND METHOD OF PRODUCTION OF SAME

TECHNICAL FIELD

The present invention relates to high strength aluminum alloy sheet requiring superior surface roughening and formability suited for home electrical appliances and automobile outer panels and other structural materials.

BACKGROUND ART

Heretofore, cold-rolled steel sheets have been used for home electrical appliances and automobile outer panels. However, recently, Al—Mg alloy sheets with high strength and excellent formability have been proposed from the demands for reduction of weight.

For example, Japanese Patent Publication (A) No. 07-278716 proposes to define the Mg content as 2.0 to 6.0 mass %, limit the Si content and Fe content to 1.5 mass % or less, continuously cast the melt to a slab thickness of 1 to 10 mm, and make a cooling rate 10° C./sec or more so as to make intermetallic compounds finely disperse in the matrix to obtain aluminum alloy sheet for forming with superior mechanical properties.

However, the aforementioned document describes evaluation of the average precipitate size, mechanical properties, and formability, but no description is seen concerning recrystallized particle size and surface roughening. In addition, the total reduction by cold rolling is only limited to being preferably 50% or more in order to finely disperse the intermetallic compounds. The other manufacturing processes are not particularly limited.

In this way, the technology in casting Al—Mg alloys with a thin slab by twin roll casting so as to finely disperse the intermetallic compounds in the matrix to produce an aluminum alloy sheet for forming with superior mechanical properties has been known in the past.

However, to further make the formability higher, it was necessary to further make the size of the intermetallic compounds smaller and to improve the surface roughening of the sheet surface after forming.

DISCLOSURE OF THE INVENTION

The present invention has as its object to provide high strength aluminum alloy sheet with both superior surface roughening and formability suitable for home electrical appliances and automobile outer panels and other structural materials and a method of production for the same.

In order to attain the aforementioned object, according to a first aspect of the invention, there is provided high strength aluminum alloy sheet having superior surface roughening and formability characterized by having a chemical composition containing Mg: 2.0 to 3.3 mass %, Mn: 0.1 to 0.5 mass %, and Fe: 0.2 to 1.0 mass %, having a balance of unavoidable impurities and Al, and having an Si among the unavoidable impurities of less than 0.20 mass % and by having an average circle equivalent diameter of intermetallic compounds of 1 μm or less, having an area ratio of intermetallic compounds of 1.2% or more, having an average diameter of recrystallized grains of 10 μm or less, and having a tensile strength of 220 MPa or more.

Further, according to a second aspect of the invention, there is provided a method of production of high strength aluminum alloy sheet of the present invention, said method being characterized by pouring an aluminum alloy melt having the chemical composition of the first aspect of the invention in a twin belt caster, continuously casting a thin slab of a thickness of 6 to 15 mm at a cooling rate of 50 to 200° C./sec at a position of ¼ the slab thickness and winding up the slab into a coil, then cold rolling the slab at a cold reduction of 60 to 98% to form a sheet, final annealing the cold rolled sheet by a continuous annealing furnace at a heating rate of 100° C./min or more and at a holding temperature of 400 to 520° C. for a holding time of within 5 minutes.

The aluminum alloy sheet of the first aspect of the invention can exhibit a superior surface roughening and formability and a high strength by defining the chemical composition, metal structure, and tensile strength.

The method of production of the second aspect of the invention realizes the metal structure and tensile strength of aluminum alloy sheet defined in the first aspect of the invention and thereby enables the production of aluminum alloy sheet exhibiting superior surface roughening and formability and high strength.

BEST MODE FOR CARRYING OUT THE INVENTION

The reasons which limit the chemical composition of the aluminum alloy sheet of the present invention are explained.

[Mg: 2.0 to 3.3 Mass %]

Mg increases the strength by the dissolving in the matrix. In addition, it increases the process hardenability and thereby contributes to the improvement of formability. If the Mg content is less than 2.0 mass %, the strength becomes low. If in excess of 3.3 mass %, the yield strength becomes too high and the shape-fixability decreases. Consequently, the Mg content is made a range of 2.0 to 3.3 mass %. The preferable Mg content is 2.5 to 3.3 mass %.

[Mn: 0.1 to 0.5 Mass %]

Mn causes fine Al—(Fe,Mn)—Si-based compounds to precipitate during casting by coexistence with Fe and Si and thereby increases the strength and improves the formability. If the Mn content is less than 0.1 mass %, this effect is not sufficient. If in excess of 0.5 mass %, Al—(Fe,Mn)—Si-based intermetallic compounds having an average particle size in excess of 1 μm form during casting of the alloy and the formability decreases. Consequently, the Mn content is made 0.1 to 0.5 mass %. The preferable Mn content is 0.1 to 0.3 mass %.

[Fe: 0.2 to 1.0 Mass %]

Fe causes fine Al—(Fe,Mn)—Si-based compounds to precipitate during casting by coexistence with Mn and Si and thereby increases the strength and improves the formability. If the content of Fe is less than 0.2 mass %, these effects cannot be expected. If the Fe content is in excess of 1.0 mass %, coarse Al—(Fe,Mn)—Si-based intermetallic compounds are formed during casting and the formability decreases. Consequently, the Fe content is made the range of 0.2 to 1.0 mass %. The preferable Fe content is 0.3 to 1.0 mass %.

[Si: Less Than 0.20 Mass %]

Si is a type of unavoidable impurity. However, if a small amount of Si coexists with Fe and Mn, it causes fine Al—(Fe,Mn)—Si-based compounds to precipitate during casting and gives the effect of raising the strength. If the content of Si is 0.20 mass % or more, coarse Al—(Fe,Mn)—Si-based intermetallic compounds are formed during casting and the formability decreases. Consequently, the Si content is made less than 0.20 mass %. The preferable Si content is 0.15 mass % or less.

[Optional Ingredient: Ti]

The optional element Ti is added mainly as an Al—Ti-based or Al—Ti—B-based crystal grain refining agent to prevent ingot cracking. However, if the Ti content is in excess of 0.10 mass %, relatively coarse AlTi-based intermetallic compounds precipitate during casting, so the formability is decreased. Consequently, the preferable Ti content is 0.10 mass % or less. The more preferable Ti content is 0.05 mass % or less.

The reasons for limitation of the microstructure of the aluminum alloy sheet of the present invention will be explained next.

[Average Circle Equivalent Diameter of Intermetallic Compounds of 1 μm or Less and Area Ratio of Intermetallic Compounds of 1.2% or More]

The intermetallic compounds in the aluminum alloy sheet of the present invention are limited to an average circle equivalent diameter of 1 μm or less and an area ratio of 1.2% or more. By extremely fine intermetallic compounds being dispersed in the matrix in this way, the movement of dislocations when forming the aluminum sheet is inhibited, together with solid solution strengthening by Mg, and a tensile strength of 220 MPa or more is achieved.

In the method of production of aluminum alloy sheet of the present invention, a melt of a predetermined composition is poured into a twin belt caster and cast into a thin slab of a thickness of 6 to 15 mm. By making the cooling rate at a position of ¼ the slab thickness 50 to 200° C./sec, Al—(Fe, Mn)—Si and other intermetallic compounds can be made to finely and uniformly precipitate and the average circle equivalent diameter of the intermetallic compounds at the final sheet can be made 1 μm or less and the area ratio of the intermetallic compounds can be made 1.2% or more.

Furthermore, by winding this slab directly into a coil, cold rolling it with a cold reduction of 60 to 98%, and performing batch final annealing or continuous annealing under predetermined conditions, it is possible to make the average particle size of recrystallized grains 10 μm or less. Since the size of the Al—(Fe,Mn)—Si-based intermetallic compounds in the ingot metal structure is fine, these intermetallic compounds act as nucleation sites for recrystallization during annealing and simultaneously give rise to a pinning effect inhibiting movement of the grain boundaries, so growth of the recrystallized grains is suppressed.

Below, the reasons for limitation of the conditions in the method of production of aluminum alloy sheet of the present invention will be explained.

[Twin-Belt Casting]

The twin-belt casting method is a continuous casting method pouring a melt between water-cooled rotary belts facing each other in the vertical direction, solidifying the melt by cooling from the belt surfaces to obtain a slab, and continuously pulling out the slab from opposite side of the belts from the pouring and winding it up into a coil.

In twin-belt casting, the back sides of the comparatively thin rotary belts are force-cooled by cooling water from nozzles. As explained below, it is possible to control the cooling rate at a position of ¼ the thin slab thickness to 50 to 200° C./sec.

[Cooling Rate at Position of ¼ Thin Slab Thickness to 50 to 200° C./Sec]

As described above, the rotary belts are force-cooled from their back sides, so the cooling rate at a position of ¼ the thin slab thickness can be made 50 to 200° C./sec. Due to this, Al—(Fe,Mn)—Si and other intermetallic compounds can be made to finely and uniformly precipitate. This is the prerequisite in order to make the average circle equivalent diameter of the intermetallic compounds 1 μm or less in the final sheet and the area ratio of the intermetallic compounds 1.2% or more.

[Slab Thickness 6 to 15 mm]

In the present invention, the thickness of the cast slab is limited to 6 to 15 mm. If the thickness of the thin slab from the twin-belt caster is less than 6 mm, the amount of aluminum passing through the caster per unit time becomes too small and casting becomes difficult. Conversely, if the thickness is in excess of 15 mm, the coil can no longer be wound. Consequently, the range of slab thickness is limited to 6 to 15 mm.

If this thickness, the solidification cooling rate during slab casting is also fast and the average circle equivalent diameter of the intermetallic compounds can be controlled to 1 μm or less and the area ratio to 1.2% or more. Due to this, an aluminum alloy sheet with superior surface roughening and formability having a recrystallized grain size in the final sheet of 10 μm or less becomes possible.

[Cold Reduction 60% to 98%]

The reduction in cold rolling is limited to 60% to 98%. By the dislocations formed by plastic working accumulating around the above fine intermetallic compounds, it becomes possible to obtain a fine recrystallized structure during the final annealing. If the reduction in cold rolling is less than 60%, the accumulation of dislocations is not sufficient and the fine recrystallized grain cannot be obtained. Conversely, if the reduction in the cold rolling is in excess of 98%, edge cracks become remarkable during rolling and the yield decreases. The preferable cold reduction is 70% to 96%.

[Conditions of Final Annealing by Continuous Annealing Furnace]

<Temperature 400 to 520° C.>

The temperature of the final annealing by a continuous annealing furnace is limited to 400 to 520° C. If less than 400° C., the energy necessary for recrystallization becomes insufficient, so a fine recrystallized structure cannot be obtained. If the holding temperature exceeds 520° C., growth of the recrystallized grains becomes remarkable, the average size of the recrystallized grains exceeds 10 μm, and the formability and surface roughening decrease.

<Holding Time Within 5 Minutes>

The holding time of continuous annealing is limited to within 5 minutes. If the holding time of continuous annealing is in excess of 5 minutes, growth of the recrystallized grains becomes remarkable, the average size of the recrystallized grains exceeds 10 μm, and the formability and surface roughening decrease.

<Heating Rate 100° C./min or More>

Regarding the heating rate and cooling rate during the continuous annealing treatment, the heating rate is preferably 100° C./min or more. If the heating rate during continuous annealing treatment is less than 100° C./min, the treatment takes too much time and the productivity decreases, so this is not preferable.

[Temperature of Final Annealing by Batch Annealing Furnace]

The temperature of the final annealing by a batch furnace is limited to 300 to 400° C. If less than 300° C., the energy necessary for recrystallization becomes insufficient, so a fine recrystallized structure cannot be obtained. If the holding temperature exceeds 400° C., growth of the recrystallized grains becomes remarkable, the average size of the recrystallized grains exceeds 10 μm, and the formability and surface roughening decrease.

The holding time of the final annealing by the batch furnace is not particularly limited, but 1 to 8 hours is preferable. If less than 1 hour, the coil may not be uniformly heated. If the holding time is in excess of 8 hours, the productivity decreases, so this is undesirable.

Examples

Alloy melts having the various chemical compositions shown in Table 1 were produced, cast into slabs of thicknesses of 10 mm by a twin-belt caster, and wound directly into coils.

TABLE 1

| | Alloy Composition (mass %) | | | | | |
|---|---|---|---|---|---|---|
| | Alloy Number | Mg | Fe | Si | Mn | Ti |
| Invention Example | A | 2.55 | 0.42 | 0.08 | 0.27 | 0.02 |
| | B | 2.57 | 0.79 | 0.08 | 0.28 | 0.02 |
| | C | 3.15 | 0.21 | 0.08 | 0.15 | 0.03 |
| Comparative Example | D | 1.00 | 0.42 | 0.08 | 0.31 | 0.02 |
| | E | 5.00 | 0.30 | 0.08 | 0.30 | 0.02 |
| | F | 2.55 | 0.07 | 0.08 | 0.29 | 0.02 |
| | G | 2.61 | 1.60 | 0.08 | 0.28 | 0.02 |
| | H | 2.55 | 0.30 | 0.08 | 0.05 | 0.02 |
| | I | 2.55 | 0.30 | 0.08 | 1.00 | 0.02 |

As a comparative example, the melt of alloy composition A was made and cast into a slab of a thickness of 5 mm by a twin-belt caster, and wound directly into a coil.

In addition, as a separate comparative example, the melt of the alloy composition A was cast into a slab of 500 mm thickness by a DC caster and further scalped, homogenized, and hot rolled by a rolling machine to obtain a hot rolled sheet of 6 mm thickness.

Next, a cold rolling machine was used to cold roll these slabs, and hot rolled sheets to obtain coils of 1 mm thickness. These coils were passed through a continuous annealing line (CAL) and annealed at 425° C. for 15 seconds.

The obtained annealed sheets were tested to evaluate their properties as follows.

[Tests to Evaluate Properties]

<Tensile Test>

JIS #5 test pieces were prepared, subjected to tensile tests at room temperature, and measured for yield strength, tensile strength, and elongation. The criteria for judgment as a product of the present invention were made a tensile strength of 220 MPa or more and an elongation of 27% or more.

<Formability Test>

The formability was evaluated using the dome height when formed by a 100 mm diameter spherical head punch as the spherical head stretching. The criteria for judgment as a product of the present invention was made a dome height of 34 mm or more.

<Surface Roughening Resistance Test>

With regards to the surface roughening, the surface of the spherical head stretched sample was visually judged as "good", "usual", and "poor". The criteria for judgment as a product of the present invention was made a "good" evaluation of rough surface characteristic.

<Evaluation of Microstructure>

(1) Measurement of Circle Equivalent Diameter and Area Ratio of Intermetallic Compounds A cross-section of the sheet was obtained, mounted, ground, and etched. The microstructure was measured by an image analyzer (LUZEX) to calculate the circle equivalent diameter (μm) and area ratio (%) of the intermetallic compounds. The criteria for judgment as a product of the present invention were a circle equivalent diameter of the intermetallic compounds of 1.0 μm or less and an area ratio of 1.2% or more.

(2) Measurement of Grain Size

In addition, the mounted sample was ground and polished, then treated in a fluoroboric acid aqueous solution to form an anodic oxide film. This was photographed by a polarizing microscope and the grain size was measured by the cross-sectional method. The criteria for judgment as a product of the present invention was a grain size of 10 μm or less.

[Calculation of Cooling Rate During Casting]

Note that the cooling rate (V) during casting was calculated by observing the microstructure in the same way as above from a piece cut out from the position of ¼ the ingot thickness and solving the following equation by the DAS (Dendrite Arms Spacing) measured by secondary branching:

$$V=(62/\mathrm{DAS})^{1/0.337}$$

According to the method of production of the present invention, the cooling rate of the ingot at a position of ¼ the slab thickness is within the range of 50 to 200° C./sec.

Table 2 shows the production conditions for the different samples and the results of evaluation in these tests mentioned above (microstructure, tensile properties, formability, and surface roughening).

TABLE 2

| | Production Conditions, Microstructure, and Properties | | | | | | | | | | | |
|---|---|---|---|---|---|---|---|---|---|---|---|---|
| | | | | | | | | | Tensile properties | | | | |
| | Sample no. | Alloy no. | Slab thickness (mm) | Cooling rate (° C./s) | Hot rolling | Size of intermetallic compounds (μm) | Area ratio of intermetallic compounds (%) | Recrystallized grain size (μm) | Yield strength (MPa) | Tensile strength (MPa) | Elongation (%) | Spherical head dome height (mm) | Surface roughening |
| Inv. ex. | 1 | A | 10 | 75 | None | 0.80 | 2.08 | 6 | 134 | 231 | 27 | 35 | Good |
| | 2 | B | 10 | 70 | None | 0.82 | 3.80 | 6 | 146 | 238 | 27 | 34 | Good |
| | 3 | C | 10 | 65 | None | 0.78 | 1.29 | 7 | 131 | 239 | 28 | 35 | Good |
| Comp. ex. | 4 | D | 10 | 75 | None | 0.80 | 1.95 | 6 | 109 | 183 | 29 | 34 | Good |
| | 5 | E | 10 | 75 | None | 0.78 | 2.02 | 6 | 165 | 310 | 27 | 32 | Good |
| | 6 | F | 10 | 75 | None | 0.78 | 1.06 | 11 | 125 | 226 | 28 | 36 | Fair |
| | 7 | J | 10 | 75 | None | 0.81 | 7.07 | 5 | 165 | 252 | 23 | 32 | Good |
| | 8 | H | 10 | 75 | None | 0.75 | 0.90 | 9 | 118 | 215 | 28 | 35 | Good |
| | 9 | I | 10 | 75 | None | 1.20 | 5.01 | 6 | 155 | 276 | 22 | 31 | Good |
| | 10 | A | 5 | 250 | None | 0.50 | 1.10 | 15 | 124 | 225 | 27 | 32 | Poor |
| | 11 | A | DC/500 | 5 | 6 mm | 4.00 | 3.44 | 18 | 120 | 221 | 26 | 33 | Poor |

Sample Nos. 1 to 3 of the invention examples had alloy compositions and manufacturing processes within the scope of the present invention and satisfy all the criteria of the microstructure and tensile properties.

Sample No. 4 of the comparative example had an Mg content of 1.0 mass %, so the alloy composition was outside the scope of the present invention, the tensile strength was low, and the criteria were not satisfied.

Sample No. 5 of the comparative example had an Mg content of 5.0 mass %, so the alloy composition was outside the scope of the present invention, the value of the spherical head dome height was low, and the criteria were not satisfied.

Sample No. 6 of the comparative example had an Fe content of 0.07 mass %, so the alloy composition was outside the scope of the present invention, the area ratio of the intermetallic compounds decreased, the grain size became somewhat large, and consequently the criteria for surface roughening was not satisfied.

Sample No. 7 of the comparative example had an Fe content of 1.6 mass %, so the alloy composition was outside the scope of the present invention, the values of the elongation and the spherical head dome height were low, and the criteria were not satisfied.

Sample No. 8 of the comparative example had an Mn content of 0.05 mass %, so the alloy composition was outside the scope of the present invention, the values of the area ratio of the intermetallic compounds and the tensile strength were low, and the criteria were not satisfied.

Sample No. 9 of the comparative example had an Mn content of 1.0 mass %, so the alloy composition was outside the scope of the present invention, the circle equivalent diameter of the intermetallic compounds was large, and the values of the elongation and spherical head dome height were low, so the criteria were not satisfied.

Sample No. 10 of the comparative example had an alloy composition within the scope of the present invention, but had a slab thickness of a thin 5 mm, so the cooling rate during casting was a fast 250° C./sec, the area ratio of the intermetallic compounds was somewhat low, the grain size was large, and consequently the value of the spherical head dome height was low and the criteria for the surface roughening was also not satisfied.

Sample No. 11 of the comparative example had an alloy composition within the scope of the present invention, but had a slab thickness of a thick 500 mm, so the cooling rate during casting was a slow 5° C./sec, the circle equivalent diameter of the intermetallic compounds was large, the grain size was also large, and value of the spherical head dome height was low and the criteria for the surface roughening was also not satisfied.

INDUSTRIAL APPLICABILITY

According to the present invention, high strength aluminum alloy sheet provided with both superior surface roughening and formability suitable for home electrical appliances and automobile outer panels and other structural materials and a method of production for the same are provided.

The invention claimed is:

1. A high strength aluminum alloy sheet having superior surface roughening and formability, said sheet having a chemical composition comprising:

Mg: 2.0 to 3.3 mass %,

Mn: 0.1 to 0.5 mass %, and

Fe: 0.79 to 1.0 mass %, having a balance of unavoidable impurities and Al, and having a Si among the unavoidable impurities of less than 0.20 mass %, and said sheet having an average circle equivalent diameter of intermetallic compounds of 1 μm or less, having an area ratio of intermetallic compounds of 3.80% or more, having an average diameter of recrystallized grains of 10 μm or less, and having a tensile strength of 220 MPa or more at room temperature.

2. A high strength aluminum alloy sheet according to claim 1, wherein the Mg content is 2.5 to 3.3 mass %.

3. A high strength aluminum alloy sheet according to claim 1, wherein the Mn content is 0.1 to 0.3 mass %.

4. A high strength aluminum alloy sheet according to claim 1, wherein the Si content is 0.15 mass % or less.

5. A high strength aluminum alloy sheet according to claim 1, wherein the Ti content is 0.10 mass % or less.

6. A high strength aluminum alloy sheet according to claim 1, wherein the Ti content is 0.05 mass % or less.

7. A high strength aluminum alloy sheet according to claim 2, wherein the Mn content is 0.1 to 0.3 mass.

8. A high strength aluminum alloy sheet according to claim 7, wherein the Si content is 0.15 mass % or less.

9. A high strength aluminum alloy sheet according to claim 8, wherein the Ti content is 0.10 mass % or less.

10. A high strength aluminum alloy sheet according to claim 9, wherein the Ti content is 0.05 mass % or less.

11. A high strength aluminum alloy sheet according to claim 1, wherein the Mg content is 2.55 to 3.15 mass %.

12. A high strength aluminum alloy sheet according to claim 1, wherein the Mn content is 0.15 to 0.28 mass %.

13. A method for preparing a high strength aluminum alloy sheet according to claim 1, said method comprising: pouring an aluminum alloy melt having the chemical composition as set forth in claim 1 in a twin belt caster, continuously casting a thin slab of a thickness of 6 to 15 mm at a cooling rate at a position of ¼ the slab thickness of 50 to 200° C./sec, winding up the slab into a coil, then cold rolling the slab at a cold reduction of 60 to 98% to form a sheet, and final annealing the cold rolled sheet by (a) a continuous annealing furnace at a heating rate of 100° C./min or more and at a holding temperature of 400 to 520° C. for a holding time of within 5 minutes, or (b) by batch annealing furnace at holding temperature of 300 to 400° C.

14. A method according to claim 13, wherein said final annealing is performed by holding in batch annealing furnace at 300 to 400° C.

15. A method according to claim 13, wherein final annealing is performed by a continuous annealing furnace at a heating rate of 100° C./min or more and at a holding temperature of 400 to 520° C. for a holding time of within 5 minutes.

* * * * *